United States Patent [19]

Elco et al.

[11] Patent Number: 4,898,546

[45] Date of Patent: Feb. 6, 1990

[54] GROUND PLANE SHIELD DEVICE FOR RIGHT ANGLE CONNECTORS

[75] Inventors: Richard A. Elco, Mechanicsburg; David F. Fusselman, Middletown, both of Pa.

[73] Assignee: E. I. Du Pont de Nemours and Company, Wilmington, Del.

[21] Appl. No.: 285,461

[22] Filed: Dec. 16, 1988

[51] Int. Cl.[4] ..... H01R 13/648

[52] U.S. Cl. ..... 439/608; 439/386; 439/607

[58] Field of Search ..... 439/607, 608, 386, 92, 439/485

[56] References Cited

U.S. PATENT DOCUMENTS

| | | | |
|---|---|---|---|
| 3,601,756 | 8/1971 | Stroh | 339/19 |
| 4,215,910 | 8/1980 | Walter | 439/608 |
| 4,232,929 | 11/1980 | Zobawa | 339/143 R |
| 4,552,420 | 11/1985 | Eigenbrode | 439/62 X |
| 4,558,917 | 12/1985 | Kamono et al. | 339/143 R |

FOREIGN PATENT DOCUMENTS

| | | | |
|---|---|---|---|
| 8707444 | 12/1987 | World Int. Prop. O. | 439/608 |

OTHER PUBLICATIONS

Du Pont Electronics Interconnect and Packaging Products Catalog 88-A; pp. 286-288; 292-293.

*Primary Examiner*—Steven C. Bishop

[57] ABSTRACT

A ground plane shield device for retro-fit application to a connector having columns of tails with a right angle bend that is previously mounted to a board includes a generally U-shaped conducting member having a closed face and three open faces. Two of the faces have clips which are arranged in corresponding pairs and which respectively grasp and electrically interconnect the member to a first and a second portion of a tail in one of the columns that is connected to ground potential.

44 Claims, 5 Drawing Sheets

GROUND PLANE SHIELD DEVICE FOR RIGHT ANGLE CONNECTORS

BACKGROUND OF THE INVENTION

1. Field of the Invention

The present invention relates to a ground plane shield device for impedance and cross talk control between signal carrying conductors emanating from an electrical connector, and in particular, to such a shield device adapted for retro-fitting to a connector that has been previously mounted to a board.

2. Description of the Prior Art

Controlling the interfering electrical effect that an electrical signal carried on a given conductor exerts on a signal carried on an adjacent conductor is especially important in high density connectors. Such control can be implemented in a variety of ways. For example, the most basic technique in a high density connector is to connect particular ones of the conductors to a predetermined ground potential, thereby causing such conductors to act similarly to ground planes and thereby to isolate the signals carried on adjacent conductors.

An alternative approach is to provide separate ground plane structures in the connector. Exemplary of this alternative are the devices disclosed in U.S. Pat. No. 4,232,929 (Zobawa) and U.S. Pat. No. 4,558,917 (Kamono et al.). In the latter patent the ground plane structures take the form of separate, spaced vertical plates disposed between adjacent columns of conductor tails emanating from a connector housing. U.S. Pat. No. 3,601,756 (Stroh) discloses a connector in which a ground plane structure is sinuously wrapped about the signal carrying conductors. Copending application Ser. No. 07/067,767,(EL-4258-A) and copending application Ser. No. 07/193,611, (EL-4271-B), both assigned to the assignee of the present invention, relate to shielding schemes for use in cables and in cable connectors.

It is more difficult to control the impedance and crosstalk effects in connectors that have not been previously designed to contain suitable interference control structures once such a connector has been mounted in position on a circuit board substrate.

Accordingly, it is believed to be advantageous to provide a ground plane shield arrangement that is particularly adapted for being expeditiously placed into use with a connector once the same has already been placed in position on a substrate.

SUMMARY OF THE INVENTION

The present invention relates to a ground plane shield device for use with a connector mounted to a generally planar substrate, the connector being of the type having a housing from which a plurality of terminal tails emanate. The tails are arranged in at least one, but typically a plurality of generally parallel columns. Each of the tails has a first portion generally perpendicular to the housing, a second portion generally perpendicular to the substrate, and an intermediate portion connecting the first and the second portions.

The ground plane shield device comprises a conducting member formed to define a first and second panel arranged in generally confrontational spaced relationship with respect to each other, the panels defining a space therebetween. Each panel has at least a first, connector, edge and a second, substrate, edge. A first and a second clip are disposed on each panel in corresponding locations along the connector and the substrate edges, respectively. The clip along the connector edge of each of the panels and the clip along the substrate edge of each of the panels extend toward the corresponding clip on the other of the panels thereby to place the corresponding clips into predetermined close proximity to each other. Each of the clips has a cutout therein, each cutout being sized to receive and to grasp a predetermined portion of a predetermined one of the tails in the column of tails, such that, in use, with the cutouts in the clips along the connector edges of the panels grasping the first portion of the predetermined one of the tails in the column and with the cutouts in the clips along the substrate edges of the panels grasping the substrate portion of the same predetermined tail the intermediate portion of all of the tails in the column is received in the space between the panels.

In the preferred instance the member is formed to define the panels by folding along a first fold line and along a second fold line generally parallel to the first whereby the ground plane shield device is a generally U-shaped member having a closed face defined between the fold lines and three open faces defined between corresponding edges of the panels.

BRIEF DESCRIPTION OF THE DRAWINGS

The invention will be more fully understood from the following detailed description thereof, taken in connection with the accompanying drawings, which form a part of this application and in which.

DETAILED DESCRIPTION OF THE INVENTION

Figure 1:
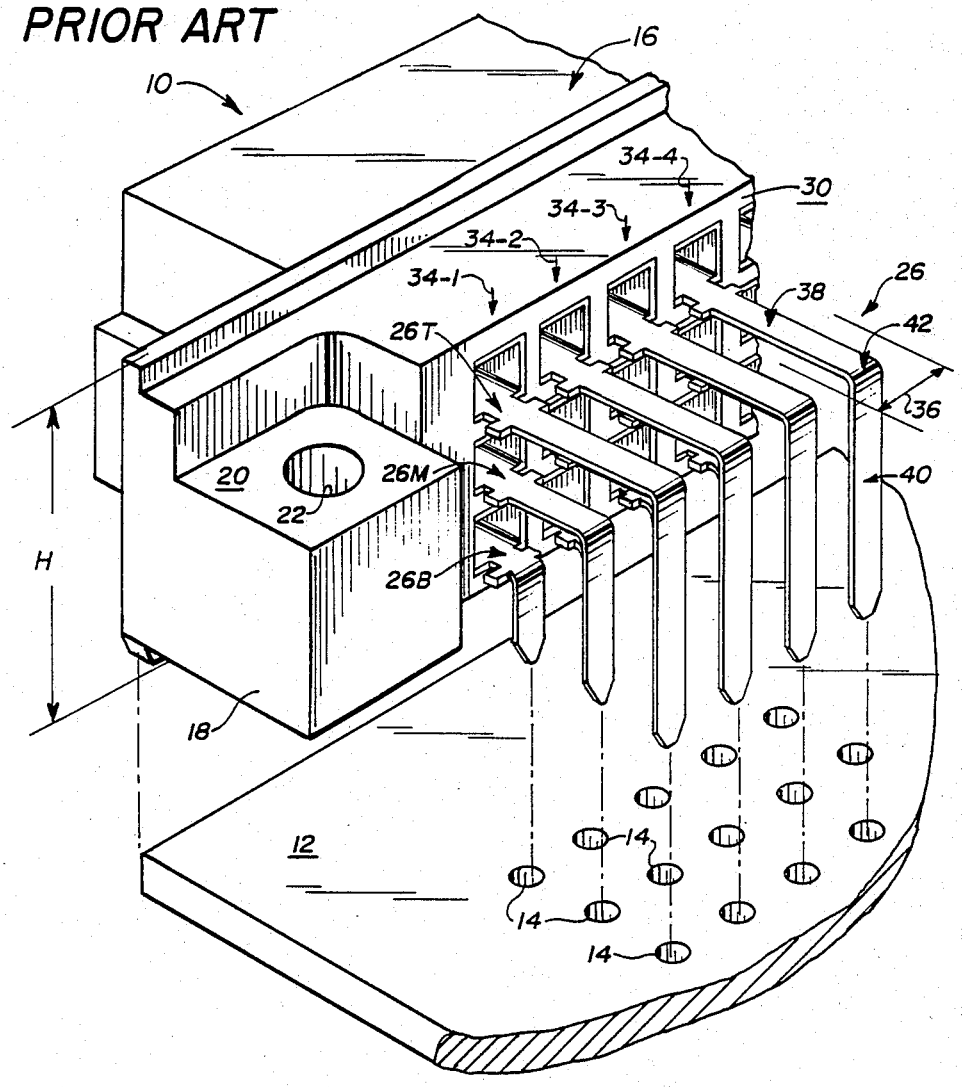
Fig. 1 PRIOR ART
FIG. 1 is a rear perspective view of a prior art connector having an array of right angle conductor tails emanating therefrom.

Throughout the following detailed description, similar reference numerals will refer to similar elements in all figures of the drawings.

FIG. 1 illustrates a rear perspective view of a typical connector of the prior art generally indicated by reference character 10. Exemplary of connectors similar to the connector 10 shown in FIG. 1 are the devices manufactured and sold by E. I. Du Pont de Nemours and Company, Incorporated as the DIN 41612-series C connector and the DIN 41612-Series R connector. The connector 10 is suitably mounted to a substrate 12, such as a printed circuit or printed wire board in a manner to be discussed, although in FIG. 1 it is spaced a predetermined distance thereabove for clarity of illustration.

The connector 10 has a generally rectanguloid housing 16 formed of an insulating material. To effect the mounting of the connector 10 to the board 12 the housing 16 is provided, in a typical instance, with a mounting abutment 18 at each end thereof. Only one of the abutments 18 is shown in FIG. 1. The abutment 18 has a planar shelf 20 thereon and a mounting opening 22 therethrough through which a mounting screw or the like may pass to secure the connector 10 to the board 12. The housing 16 extends a predetermined height dimension H above the surface of the board 12 when the connector 10 is mounted thereto.

Figure 4:
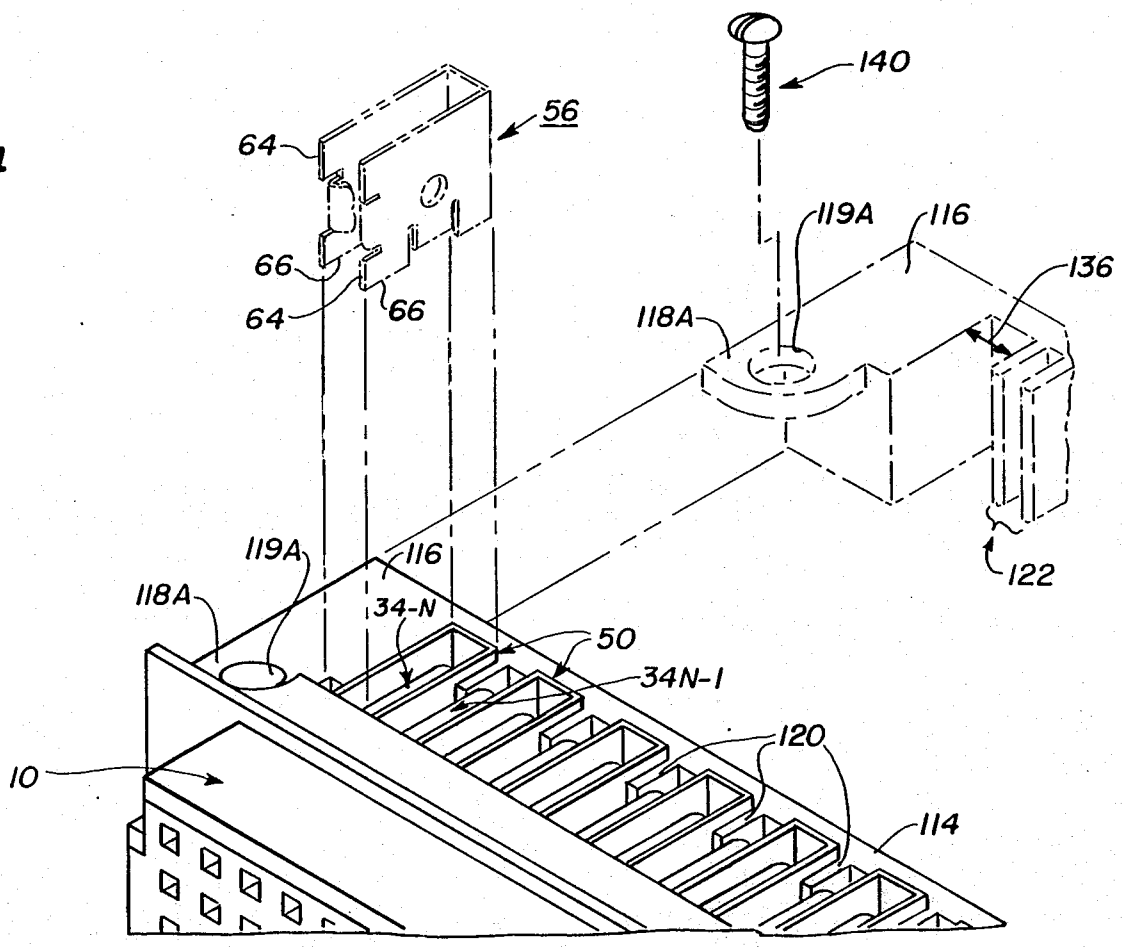
FIG. 4 is an enlarged view of the exploded portion of FIG. 3 again with a portion of the securing means for securing the shield device to the board being illustrated as in securing position (solid lines) and in retracted position (dotted lines)

Disposed within the housing 16 is a plurality of electrical contacts of either the male of female type. Each of the contacts has a tail generally indicated by the reference character 26 associated therewith. In FIG. 1 the tails 26 emanate from the rear surface 30 of the housing 16 in an array containing a predetermined plurality N of vertical columns 34-1 through 34-N (FIG. 4). Only four such adjacent columns 34-1 through 34-4 are shown in FIG. 1. Each column 34 contains a vertically aligned stack of conductor tails 26. Although any predetermined number of tails 26 may be arranged in each stack, in FIG. 1 each column 34 is shown to contain three such tails 26, with the top tail in a given column is indicated by the suffix "T", the middle tail being indicated by the suffix "M", and the bottom tail being indicated by the suffix "B".

It is a typical practice in the art that one of the contacts associated with one of the tails 26 in each of the columns 34 be connected to a predetermined ground potential. As used herein, it should be emphasized that ground potential is referenced from the point of view of a signal carrying conductor. Thus, the term is construed herein to include power connections, chassis grounds, and logic grounds. The tail 26 itself therefore also lies at this predetermined ground potential. For purposes of discussion herein it is assumed that the middle tail 26M in each of the columns 34 is connected to this predetermined ground potential. Each of the columns 34 has a predetermined transverse dimension 36 associated therewith, where the dimension 36 includes the transverse dimension of the tail 26 itself as well as some predetermined buffer distance adjacent each side of each of the tails.

Each of the tails 26 comprises a first portion 38, a second portion 40 and a third portion 42. The first portion 38 is termed the connector portion since it is in proximity to the rear surface 30 of the housing 16 and lies generally perpendicular thereto. The third portion 42 is termed the substrate portion since it is proximal to and generally perpendicularly arranged with respect to the substrate 12. When the connector 10 is affixed to the substrate 12 the third portion 42 of each of the tails 26 extends through an opening 14 provided in the substrate 12. The second portion 40 is intermediate the first portion 38 and third portion 42 and, in the prior art connector illustrated, contains a generally right angle bend therein. Of course, it should be understood that the portions 38 and 42 need not, as is illustrated, be completely perpendicular to the connector and the board, nor, as illustrated, must the intermediate portion 40 be a right angle bend, inasmuch as the present invention may be configured for use with alternate configurations of these elements.

Figure 2:
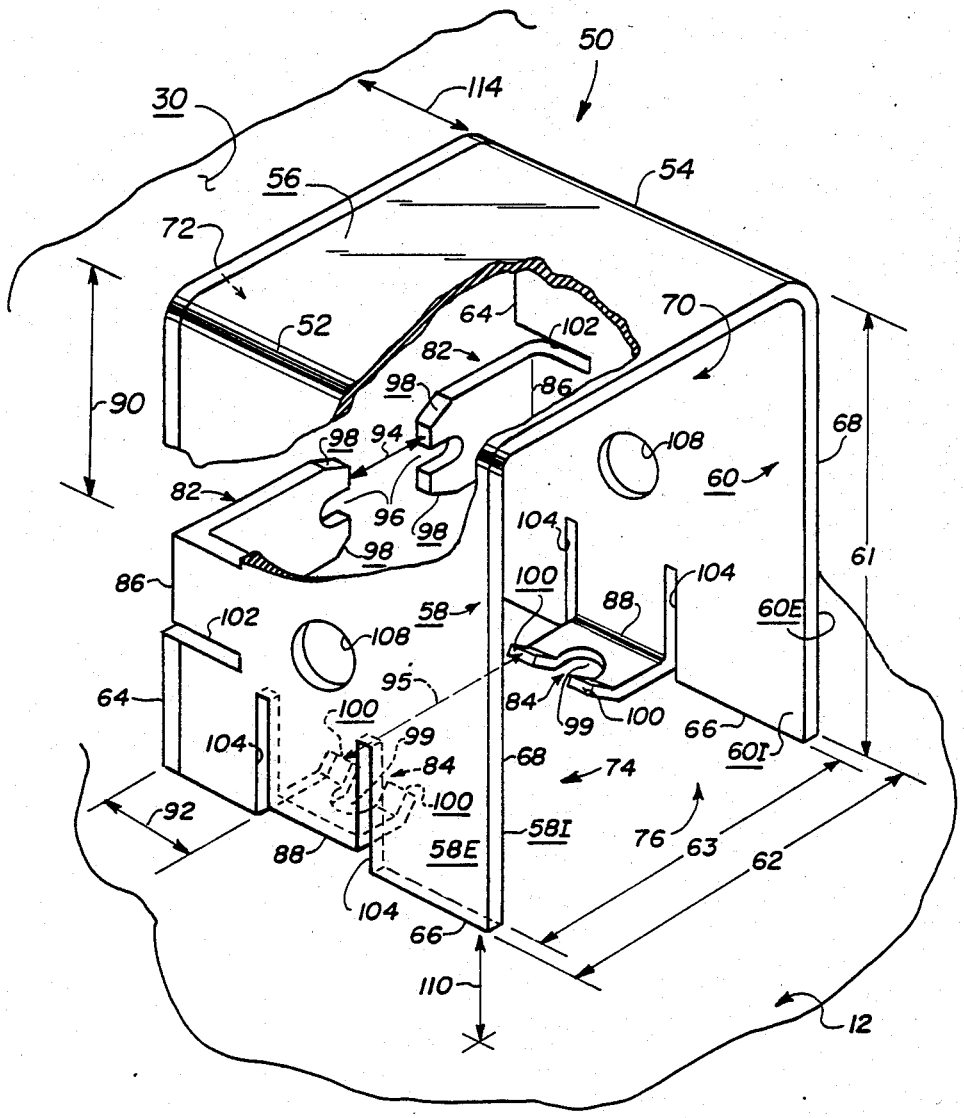
FIG. 2 is a highly stylized rear perspective view of a ground plane shield device in accordance with the present invention with portions thereof removed for clarity of illustration, the shield device being disposed with respect to a substrate with the closed end of the device parallel to the surface of the substrate.

FIG. 2 is a highly stylized rear perspective illustration of a ground plane shield device generally indicated by the reference character 50 in accordance with the present invention, with portions thereof removed for clarity. The device 50 is adapted to be retro-fit to a connector 10 already positioned on and secured to a substrate 12. The device 50, in the preferred case, comprises a member made of a conducting material, such as phosphor bronze or beryllium copper. Preferably the device 50 is formed, as will be discussed, by folding the same along a first fold line 52 and a second fold line 54 to define a generally U-shaped structure having a web portion 56, a first panel 58 and a second panel 60.

Each panel 58, 60 is generally square in shape and preferably has a dimension 61 that is selected such that when the device 50 is in position about the tails (and there supported in a manner to be described) the top surface of the web 56 is spaced above the substrate 12 a distance substantially equal to the height dimension H of the housing 12. The panels 58, 60 each have an interior surface 58I, 60I and an exterior surface 58E, 60E thereon. The exterior surfaces 58E, 60E of the panels are spaced by a predetermined distance 62, while the interior surfaces are spaced a predetermined distance 63. The distances 61, 62 and 63 can have any desired relationship with respect to each other, it being only necessary that the distance 63 be substantially equal to the distance 36, for reasons that should become apparent herein.

It should be understood that the panels 58, 60 may be formed by bending or folding a planar member along a single, double (as illustrated) or other predetermined number of multiple folds or by rolling the same and, in all events, remain within the contemplation of the present invention. Thus, for example, it should be understood that the device 50 may be formed with only one fold line, in which event the device has imparted thereto a generally V-shape. Alternately, more than two fold lines may be used to define the panels, in which event there is imparting a generally corrugated configuration to the web portion 56 of the device 50. Yet further, the member may be formed by rolling in which case the upper portion thereof will exhibit a generally domed shape.

Figure 3:
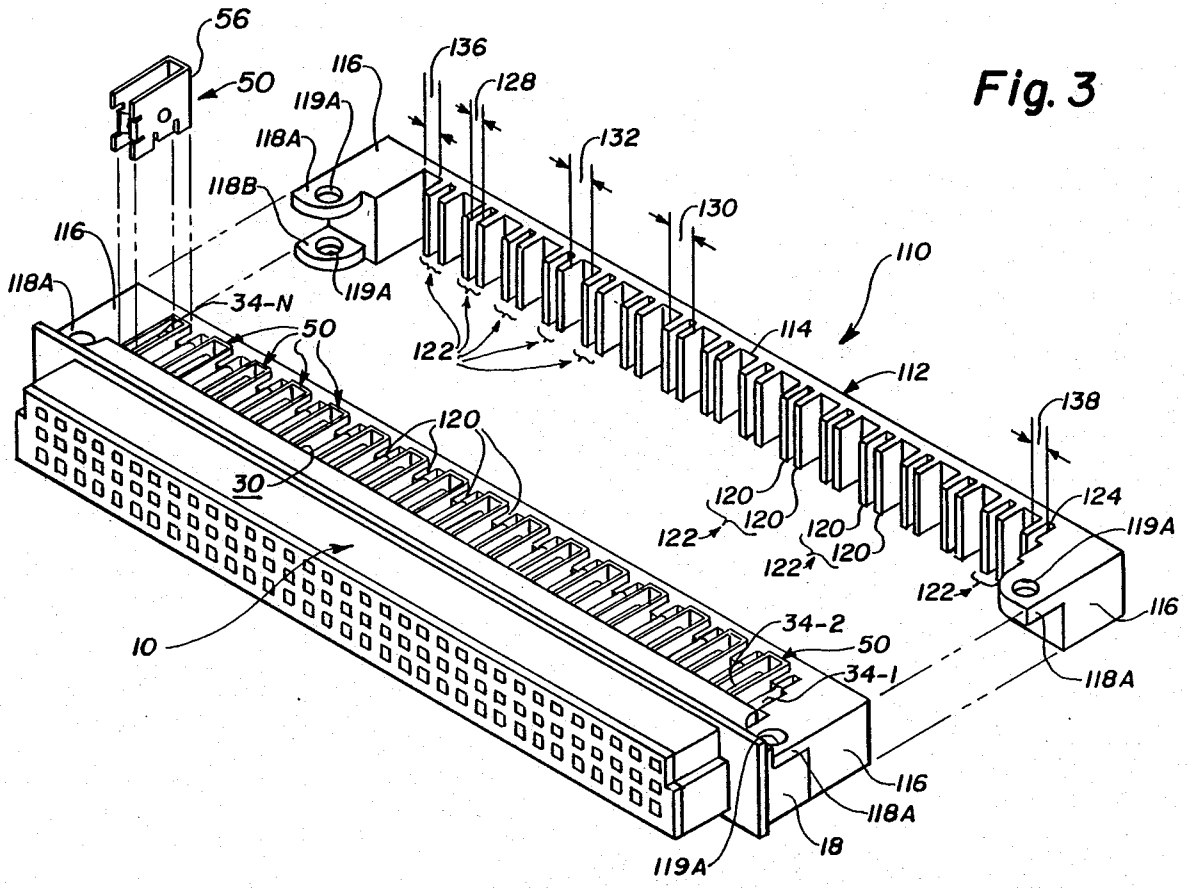
FIG. 3 is a front perspective view of a board mounted connector such as shown in FIG. 1 with the ground plane shield device in accordance with the present invention being disposed with respect thereto in an alternate position from that shown in FIG. 2, with one of the ground plane shield devices being exploded from its position, with securing means for securing the shield device to the board being illustrated as in securing position (solid lines) and in retracted position (dotted lines)

Each panel 58, 60 has a first, connector, edge 64, a second, substrate, edge 66, and a third, free, edge 68 thereon. The fourth edge of each panel 58, 60 is defined by the respective fold line 52, 54. The panels 58 and 60 lie generally parallel to each other in confrontational spaced-apart relationship. The panels 58, 60 and the web 56 cooperate to define an interior space 70. The device 50 has a first open face 72 defined between the opposed connector edges 64 of the panels 58, 60, a second open face 74 defined between the opposed substrate 66 edges of the panels 58, 60, and a third open face 76 defined between the free edges 68 of the panels 58, 60. The fourth face of the device 50 is closed by the web 56 defined between the fold lines 52, 54. In the embodiment shown in FIG. 2 the web 56 is, in use, disposed generally parallel to and spaced in overlying relationship with respect to the substrate 12. However, the device 50 may be used with the web 56 disposed perpendicular to the surface of the substrate 12. Thus, as seen in the embodiment shown in FIGS. 3 and 4, the edges defining the connector edges 64 and the substrate edges 66 differ from those shown in FIG. 2. In FIGS. 3 and 4, the connector edges 64 are defined by the edges of the panels opposite from the fold lines 52, 54 defining the web 56 while the substrate edges 66 are defined by the edges adjacent to the web 56.

Each panel 58, 60 has a first clip 82 and a second clip 84 disposed in corresponding locations along the edges of the panels defining two of the three open faces. In the embodiment illustrated in FIG. 2 the device 50 is shown to have clips 82, 84 on the faces 72, 74 respectively defined by corresponding connector edges 64 and corresponding substrate edges 66. That is, in the embodiment of FIG. 2 the clips 82 are provided on the face 72 defined on the connector edges 64 lying adjacent to the web 66 and the clips 84 are defined on the substrate edges 76 that lie opposite from the web 56. In the embodiment illustrated in FIGS. 3 and 4 the device 50 is shown to have the clips 82 on the face 74 defined by corresponding connector edges 66 and the clips 84 on the face 76 defined by corresponding substrate edges 68. It should be understood that consistent with the foregoing discussion the device 50 may be configured to have only two open faces (i.e., a connector face 72 and a substrate face 74) or more than three open faces, if desired. Any of these alternative configurations is to be construed as lying within the contemplation of the invention.

Each clip 82 is formed on the respective panel on which it is disposed by folding the material of the panel along a fold line 86 toward the confrontationally disposed other of the panels. The clips 84 are formed on their respective panel in a similar manner by folding the material of the panel along a fold line 88 toward the confrontationally disposed other of the panels. Each of the fold lines 86, 88 lies generally parallel to the edge of the panel on which the clip is associated. The clips 82, 84 are spaced a respective predetermined distance 90, 92 along the edge of the panel from which it is defined for a purpose to be made clearer herein.

When formed the confronting pairs of clips 82, 84 lie are spaced apart a predetermined close distances 94, 95. The magnitudes of the distances 94, 95 are related to the thickness dimension of selected predetermined portions of the tails 26. It should be understood that the clips 82, 84 may take a variety of forms, so long as they are arranged so as to support the shield above the substrate and from the connector and so as to engage the predetermined portion of a selected one of the tails and thereby electrically connect each panel of the shield to the tail at both points where the clips 82, 84 engage the same.

Each clip 82 has a cut-out 96 formed therein, the cut-outs 96 being bounded on each side thereof by a lead-in surface 98. Similarly, each of the clips 84 has a cut-out 99 formed therein. The cut-outs 99 are bounded on each side thereof by a lead-in surface 100. The panels 58, 60 are preferably slotted, as at 102, 104, respectively, in the vicinity of the respective clips 82, 84 to impart flexibility thereto. Each of the panels 58, 60 is also provided with a depression or dimple 108, for a purpose to be described.

In use, the shield device 50 is supported by the clips 82, 84 a predetermined distance 110 above the substrate 12 and a predetermined distance 114 from the surface 30 of the connector 10 to straddle a predetermined one of the columns 34 of the tails 26 emanating from the surface 30 thereof. The desired final mounted position for the shield 50 is to dispose the cut-outs 96 on the clips 82 provided on the connector edges of the shield 50 in engagement against the connector portion 38 of the tail 26M (i.e., the tail connected to ground potential) and to dispose the cut-outs 98 on the clips 84 provided on the substrate edges of the device 50 in engagement against the substrate portion 40 of the tail 26M. When so engaged, the remainder of the tail 26M as well as the entirety of the remaining tails 26T and 26B in the selected column 34 lie within the space 70 encompassed by the confronting panels 58, 60 and the web 56 of the device 50. As the device 50 straddles the selected column the dimples 108 on the panels 58, 60 abut against the intermediate portion 42 of the tail 26M, thereby providing mounting stability to the device 50. The distances 90, 92 are, therefore, selected to position the clips 84, 86 so that they are respectively adjacent to the portion of the tail against which they grasp and simultaneously when so grasping the appropriate portion of the tail, to support the device 50 the distances 110, 114 from the substrate 12 and the face 30 of the connector 10. As noted earlier the top surface of the web 56 should preferably be spaced above the substrate 12 a distance substantially equal to the height dimension H of the housing 12.

The panels 58, 60 are introduced over the selected column 34 in a manner that brings one set of clips and then the other set of clips over the tails in the column. As the clips 82 and 84 are moved over the tails 26, they are urged apart owing to the reaction of the lead-in 98, 100, as the case may be, against the tails 26. The resiliency imparted to the clips 82, 84 by the slots 102, 104, respectively, in the panels 58, 60 assists in this action. Note that if the motion of the device 50 is sufficiently fast the clips 82, 84 move past any preceding tail 26 before the clip can resiliently return into gripping position, thus to prevent a clip from clasping onto other than the tail of interest.

The gripping engagement of the clips 82, 84 and the tail 26M serves to properly terminate the panels 58, 60 and electrically interconnect the device 50 to the same potential at which the tail 26M is maintained. For this purpose the device 50 is therefore, preferably fabricated of a conductive material. However, it should be understood that the member may be other than a conductor, if the interior surface of the panels thereof and the clips are lined with a conductive material to establish the electrical connections to be discussed. The panels are sized to provide a sufficiently large surface so that ground return currents associated with the signal carrying conductors disposed within the space 70 and surrounded by the device 50 can flow in the panels as needed to minimize the inductance associated with the ground path.

Since, in practice, it is the usual case that each column 34 includes a tail 26 that is connected to the predetermined ground potential it is anticipated that shield devices 50 in accordance with the invention will therefore, in use, be provided over alternate columns of tails. FIG. 3 illustrates a typical instance of this arrangement. It should also be understood that the particular one of the tails in a column that is connected to ground potential may vary, possibly from column to column across the connector. Thus, in such instances the magnitude of the distances 90 and 92 will then depend upon the location of the particular one of the tails so connected to ground potential such that the interconnection between the grounded tail and the shield can occur.

However, it also lies within the contemplation of the invention to size the interior transverse dimension 63 of the device 50 to a degree that the panels 58, 60 are able to encompass more than one of the columns of tails. That is, the interior dimension 63 may be substantially equal to or greater than twice the distance 36, or some other desired multiple thereof. In this event the clips 82, 84 on one of the panels will contact against one of the ground potential tails while the clips 82, 84 on the other of the panels will contact against a different one of the grounded tails.

As an aid in holding the devices 50 in place securing means 110 for holding the shield devices 50 in their desired disposition over the selected column(s) of tails is provided. In the preferred instance the securing means 110 comprises an elongated comb-like member 112 formed from an insulating plastic material. The member 112 includes a baseplate 114 having mounting abutments 116 at each end thereof. The abutments 116 are initially provided with upper and lower fastening tabs 118A, 118B. Each tab 118 has an aperture 119A, 119B respectively therein. An array of teeth 120 extends from the baseplate 112.

The individual teeth 120 are arranged in pairs 122 across the length of the baseplate 114 (as shown in FIG. 3), except near one end thereof, where a single, unpaired tooth 124 is provided. The gap 128 between the interior confronting surfaces of the teeth 120 in a given pair 122 is substantially equal to the dimension 36 (FIG. 1) of a column 34 of tails 26. These gaps 128 between the interior confronting surfaces of the teeth in a given pair 122 of teeth are thus sized to accept the tails 26 of those columns 34 over which no shield device 50 is provided.

The distance 130 between the exterior surfaces of the teeth 120 in any given pair 122 of teeth is substantially equal to the exterior transverse distance 62 (FIG. 2) of each of the shields 50.

The gap 132 between a first tooth in one pair of teeth and a second tooth disposed in an adjacent pair of teeth is also substantially equal to the exterior transverse distance 62 (FIG. 2) of each of the shields 50. Thus these gaps 132 are sized to accommodate the device 50 and engage the exterior surfaces 58E, 60E of the panels 58, 60 of a shield 50. If the transverse exterior dimension 62 of the shield 50 is enlarged, as discussed earlier, or if the transverse dimension 62 is diminished for electrical reasons, the above-discussed distances between the surfaces on the teeth in a given pair of teeth and the distances between surfaces on teeth in adjacent pairs of teeth are commensurately altered.

The gaps 136 and 138 provided between the abutments 116 and the first pair 122 of teeth at one end of the baseplate 114 and between the other abutment 116 and the unpaired tooth 124 at the other end of the baseplate 114 are respectively sized to substantially equal the exterior transverse dimension 62 and substantially one-half of the exterior transverse dimension 62 of the shield device 50. Thus, the member 112 may accommodate an arrangement of shield devices 50 in which the first column 34-1 of the tails 26 is covered by a shield device (in which event the end of the baseplate 114 having the larger gap 136 is used adjacent to that end of the connector 10) or in which the second column 34-2 of the tails is covered by a shield device 50 (in which event the end of the baseplate 114 having the smaller gap 138 is used to surround the exposed first column 34-1 of tails).

As noted the abutments 116 have fastening tabs 118A, 118B originally provided thereon. Depending upon which end of the baseplate 114 (i.e., the end having the gap 136 or the end having the gap 138) is positioned adjacent to the end of the connector housing 16 the appropriate tab 118A, 118B is removed. Thus the remaining tab 118 is positioned on the shelf 20 so that the aperture 119 in the tab 118 registers with the opening 22 in the abutment 18. With the opening 22 and the aperture 119 aligned any suitable mounting hardware, such as the fastener schematically indicated at reference character 140 (which form part of the securing means 110) may pass to hold the member 112 and the connector 10 to the board 12. The member 112 may be used with either the embodiment of the invention shown in FIG. 2 (in which the web 56 is parallel to the board 12) or in the embodiment of the invention shown in FIGS. 3 and 4 (in which the web 56 is perpendicularly to the board 12). In a given application some of the shields may be disposed as in FIG. 2 and others as in FIG. 3, if desired.

Figure 5:
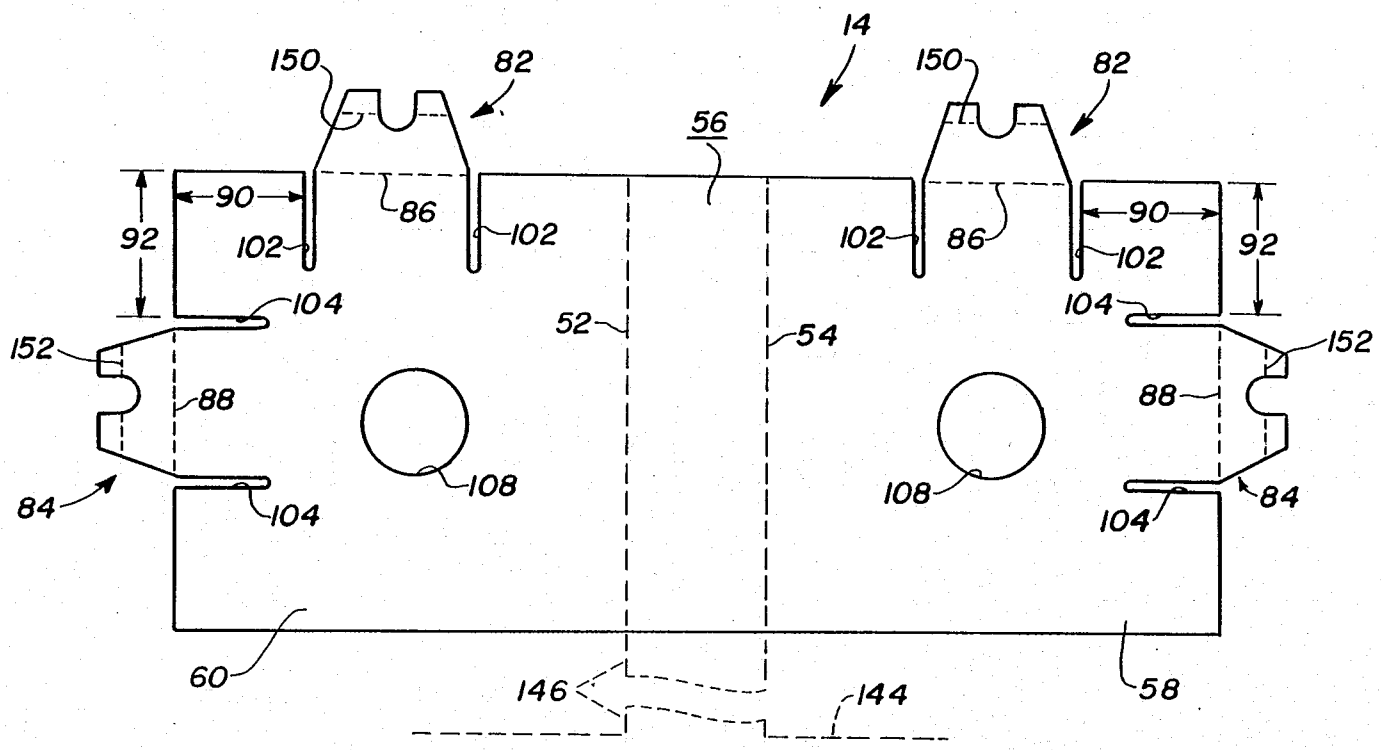
FIG. 5 is a plan view of a blank from which the ground plane shield device in accordance with the present invention is formed.

With reference to the plan view of the blank 142 shown in FIG. 5, the manner in which the shield devices 50 are formed from the blank may be understood. Each of the individual developed shields 50 are connected to a lead frame 144 by a tab 146. In a first manufacturing operation, the dimple 108 is stamped into the panels 58, 60. Thereafter, using a progressive die pair, the ends of the clips 82, 84 are folded one hundred thirty five degrees along fold lines 150, 152 toward the panel with which they are associated. The clips 82, 84 on each of the panels are then themselves folded along the fold lines 86, 88. Finally the member is folded along the fold lines 52, 54 to define the panels 58, 60 and the web 56. The comb 114 is formed by extrusion from a die and subsequently sliced.

Those skilled in the art, having the benefit of the teachings of the present invention as hereinabove set forth, may effect numerous modifications thereto. It should be understood, however, that such modifications are to be construed to lie within the contemplation of the present invention, as defined by the appended claims.

What is claimed is:

1. A ground plane shield device for use with a connector mounted to a generally planar substrate, the connector being of the type having a housing from which a plurality of terminal tails emanate, the tails being arranged in at least one column, the tails each having a first portion generally perpendicular to the housing, a second portion generally perpendicular to the substrate, and an intermediate portion connecting the first and the second portions, the shield comprising:

a conducting member formed to define a first and a second panel arranged in generally confrontational spaced relationship with respect to each other, the panels defining a space therebetween, each panel having at least a first, connector, edge and a second, substrate, edge;

a first and second clip disposed on each panel in corresponding locations along the connector and the substrate edges, respectively, the clip along the connector edge of each of the panels and the clip along the substrate edge of each of the panels extending toward the corresponding clip on the other of the panels thereby to place the corresponding clips into predetermined close proximity to each other, each of the clips being arranged to receive and to grasp a predetermined portion of a predetermined one of the tails in the column of tails thereby to support the device above a substrate and to connect electrically the tails to the panel, such that, in use, with the cutouts in the clips along the connector edges of the panels grasping the first portion of the predetermined one of the tails in the column and with the cutouts in the clips along the substrate edges of the panels grasping the substrate portion of the same predetermined tail the intermediate portion of all of the tails in the column is received in the space between the panels.

2. The ground plane shield device of claim 1 wherein the member is formed by folding along at least one fold line to define the panels.

3. The ground plane shield device of claim 2 wherein the clips are placed into predetermined close proximity to each other by folding each of the clips along predetermined fold lines.

4. The ground plane shield device of claim 1 wherein the clips are placed into predetermined close proximity to each other by folding each of the clips along predetermined fold lines.

5. The ground plane shield device of claim 1 further comprising means for securing the shield to the substrate.

6. The ground plane shield device of claim 5 wherein the panels each have an exterior surface thereon and wherein exterior surfaces are separated by a predetermined dimension, the securing means comprising a comb having a baseplate having a pair of teeth, each of the teeth having an exterior surface thereon, the exterior surfaces of the teeth being spaced apart by a predetermined spacing, the spacing between the exterior surfaces of the teeth being substantially equal to the dimension between the exterior surfaces of the panels.

7. The ground plane shield device of claim 6 wherein the baseplate has a mounting abutment thereon, the mounting abutment being spaced from the exterior surface of one of the teeth by a predetermined distance substantially equal to one-half the predetermined distance by which the exterior surfaces of the paired teeth are spaced.

8. The ground plane shield device of claim 6 wherein wherein the baseplate has a mounting abutment thereon, the mounting abutment being spaced from the exterior surface of one of the teeth by a predetermined distance substantially equal to the predetermined distance by which the exterior surfaces of the paired teeth are spaced.

9. The ground plane shield device of claim 8 wherein the connector housing has a mounting opening therein, and wherein the mounting abutment has a mounting aperture therein, the aperture in the mounting abutment being positionable in registered relationship with the opening in the connector housing.

10. The ground plane shield device of claim 7 wherein the connector housing has a mounting opening therein, and wherein the mounting abutment has a mounting aperture therein, the aperture in the mounting abutment being positionable in registered relationship with the opening in the connector housing.

11. The ground plane shield device of claim 5 wherein the panels each have an exterior surface thereon and wherein exterior surfaces are separated by a predetermined dimension, the securing means comprising a comb having a baseplate having a first tooth and a second tooth disposed in adjacent confrontational relationship, each of the teeth having a surface thereon, the surfaces of the teeth being spaced apart by a predetermined spacing, the spacing between the surfaces of the teeth being substantially equal to the dimension between the exterior surfaces of the panels.

12. The ground plane shield device of claim 5 wherein the the column of tails has a predetermined transverse dimension associated therewith, the securing means comprising a comb having a baseplate having a pair of teeth, each of the teeth having an interior surface thereon, the interior surfaces of the teeth being spaced apart by a predetermined spacing, the spacing between the interior surfaces of the teeth being substantially equal to the transverse dimension of the column of tails.

13. The ground plane shield device of claim 4 wherein the panels are each slotted in the vicinity of the clips whereby the clips are resiliently movable with respect to the panel to which they are connected.

14. The ground plane shield device of claim 3 wherein the panels are each slotted in the vicinity of the clips whereby the clips are resiliently movable with respect to the panel to which they are connected.

15. The ground plane shield device of claim 2 wherein the panels are each slotted in the vicinity of the clips whereby the clips are resiliently movable with respect to the panel to which they are connected.

16. The ground plane shield device of claim 1 wherein the panels are each slotted in the vicinity of the clips whereby the clips are resiliently movable with respect to the panel to which they are connected.

17. The ground plane shield device of claim 16 wherein the panels each have a depression therein, the depressions being disposed at corresponding locations on the panels arranged such that, in use, the depressions engage the intermediate portion of one of the tails in the column.

18. The ground plane shield device of claim 15 wherein the panels each have a depression therein, the depressions being disposed at corresponding locations on the panels arranged such that, in use, the depressions engage the intermediate portion of one of the tails in the column.

19. The ground plane shield device of claim 2 wherein the connector housing has a predetermined height dimension associated therewith and wherein the panels each have a predetermined height dimension associated therewith, the height dimension of the panels being substantially equal to the height dimension of the connector housing.

20. The ground plane shield device of claim 1 wherein the connector housing has a predetermined height dimension associated therewith and wherein the panels each have a predetermined height dimension associated therewith, the height dimension of the panels being substantially equal to the height dimension of the connector housing.

21. A ground plane shield device for use with a connector mounted to a generally planar substrate, the connector being of the type having a housing from which a plurality of terminal tails emanate, the tails being arranged in at least two adjacent columns with each column having a predetermined number of tails therein, each tail having a first portion generally perpendicular to the housing, a second portion generally perpendicular to the board, and an intermediate portion connecting the first and the second portions, at least a predetermined one of the tails in at least one column being connectable to ground potential, the ground plane shield device comprising:

a conducting member folded along at least one fold line to define a first and a second panel arranged in generally confrontational spaced relationship with respect to each other, the panels defining a space therebetween, each panel having at least a first, connector, edge and a second, substrate, edge, a first and second clip disposed on each panel in corresponding locations along the connector and the substrate edges, respectively, the clip along the connector edges of each of the panels and the clip along the substrate edges of each of the panels being folded along predetermined fold lines to extend toward the corresponding clip on the other of the panels thereby to place the corresponding clips into predetermined close proximity to each other.

each of the clips having cutouts therein, the cutouts in the clips along the connector edges of the panels being sized to accept the first portion of a predetermined one of the tails in a first of the columns connectable to ground potential while the cutouts in the clips along the substrate edges of the panels being sized to accept the substrate portion of the same predetermined one of the tails in the first of the columns, the clips thereby acting to support the device above a substrate and to connect electrically the tails to the panel, such that, in use, the intermediate portion of all of the tails in the column having the predetermined tail therein is received in the space between the panels.

22. The ground plane shield device of claim 21 wherein the conducting member is folded along a second fold line generally parallel to the first, and wherein the panels each have a first, a second and a third edge, one of which is the connector edge and another of which is the substrate edge, whereby the shield is a generally U-shaped member having a closed face defined between the fold lines and three open faces defined between corresponding edges of the panels.

23. The ground plane shield device of claim 22 wherein the connector edges of the panels are on an open face of the shield adjacent to the closed face and wherein the substrate edges of the panels are on an open face of the shield opposite from the closed face.

24. The ground plane shield device of claim 22 wherein the connector edges of the panels are on an open face of the shield opposite from the closed face and wherein the substrate edges of the panels are on an open face of the shield adjacent to the closed face.

25. The ground plane shield device of claim 24 further comprising means for securing the shield to the substrate.

26. The ground plane shield device of claim 25 wherein the panels each have an exterior surface thereon and wherein exterior surfaces are separated by a predetermined dimension, the securing means comprising a comb having a baseplate having a pair of teeth, each of the teeth having an exterior surface thereon, the exterior surfaces of the teeth being spaced apart by a predetermined spacing, the spacing between the exterior surfaces of the teeth being substantially equal to the dimension between the exterior surfaces of the panels.

27. The ground plane shield device of claim 26 wherein the baseplate has a mounting abutment thereon, the mounting abutment being spaced from the exterior surface of one of the teeth by a predetermined distance substantially equal to one-half the predetermined spacing by which the exterior surfaces of the teeth are spaced.

28. The ground plane shield device of claim 25 wherein the baseplate has a mounting abutment thereon, the mounting abutment being spaced from the exterior surface of one of the teeth by a predetermined distance substantially equal to the predetermined spacing by which the interior surfaces of the teeth are spaced.

29. The ground plane shield device of claim 28 wherein the connector housing has a mounting opening therein, and wherein the mounting abutment has a mounting aperture therein, the aperture in the mounting abutment being positionable in registered relationship with the opening in the connector housing.

30. The ground plane shield device of claim 27 wherein the connector housing has a mounting opening therein, and wherein the mounting abutment has a mounting aperture therein, the aperture in the mounting abutment being positionable in registered relationship with the opening in the connector housing.

31. The ground plane shield device of claim 25 wherein the panels each have an exterior surface thereon and wherein exterior surfaces are separated by a predetermined dimension, the securing means comprising a comb having a baseplate having a first tooth and a second tooth disposed in adjacent confrontational relationship, each of the teeth having a surface thereon, the surfaces of the teeth being spaced apart by a predetermined spacing, the spacing between the surfaces of the teeth being substantially equal to the dimension between the exterior surfaces of the panels.

32. The ground plane shield device of claim 25 wherein the the column of tails has a predetermined transverse dimension associated therewith, the securing means comprising a comb having a baseplate having a pair of teeth, each of the teeth having an interior surface thereon, the interior surfaces of the teeth being spaced apart by a predetermined spacing, the spacing between the interior surfaces of the teeth being substantially equal to the transverse dimension of the column of tails.

33. The ground plane shield device of claim 23 further comprising means for securing the shield to the substrate.

34. The ground plane shield device of claim 33 wherein the panels each have an exterior surface thereon and wherein exterior surfaces are separated by a predetermined dimension, the securing means comprising a comb having a baseplate having a pair of teeth, the teeth having an interior surface thereon, the interior surfaces of the teeth being spaced apart by a predetermined spacing, the spacing between the interior surfaces of the teeth being substantially equal to the dimension between the exterior surfaces of the panels.

35. The ground plane shield device of claim 34 wherein the teeth each have an exterior surface thereon and wherein the baseplate has a mounting abutment thereon, the mounting abutment being spaced from the exterior surface of one of the teeth by a predetermined distance substantially equal to one-half the predetermined spacing by which the interior surfaces of the teeth are spaced.

36. The ground plane shield device of claim 33 wherein the teeth each have an exterior surface thereon and wherein the baseplate has a mounting abutment thereon, the mounting abutment being spaced from the exterior surface of one of the teeth by a predetermined distance substantially equal to the predetermined spacing by which the interior surfaces of the teeth are spaced.

37. The ground plane shield device of claim 36 wherein the connector housing has a mounting opening therein, and wherein the mounting abutment has a mounting aperture therein, the aperture in the mounting abutment being positionable in registered relationship with the opening in the connector housing.

38. The ground plane shield device of claim 35 wherein the connector housing has a mounting opening therein, and wherein the mounting abutment has a mounting aperture therein, the aperture in the mounting abutment being positionable in registered relationship with the opening in the connector housing.

39. The ground plane shield device of claim 33 wherein the panels each have an exterior surface thereon and wherein exterior surfaces are separated by a predetermined dimension, the securing means comprising a comb having a baseplate having a first tooth and a second tooth disposed in adjacent confrontational relationship, each of the teeth having a surface thereon, the surfaces of the teeth being spaced apart by a predetermined spacing, the spacing between the surfaces of the teeth being substantially equal to the dimension between the exterior surfaces of the panels.

40. The ground plane shield device of claim 33 wherein the the column of tails has a predetermined transverse dimension associated therewith, the securing means comprising a comb having a baseplate having a pair of teeth, each of the teeth having an interior surface thereon, the interior surfaces of the teeth being spaced apart by a predetermined spacing, the spacing between the interior surfaces of the teeth being substantially equal to the transverse dimension of the column of tails.

41. The ground plane shield device of claim 24 wherein the panels each have a depression therein, the depressions being disposed at corresponding locations on the panels arranged such that, in use, the depressions engage the intermediate portion of one of the tails in the column.

42. The ground plane shield device of claim 23 wherein the panels each have a depression therein, the depressions being disposed at corresponding locations on the panels arranged such that, in use, the depressions engage the intermediate portion of one of the tails in the column.

43. The ground plane shield device of claim 22 wherein the panels each have a depression therein, the depressions being disposed at corresponding locations on the panels arranged such that, in use, the depressions engage the intermediate portion of one of the tails in the column.

44. The ground plane shield device of claim 21 wherein the panels each have a depression therein, the depressions being disposed at corresponding locations on the panels arranged such that, in use, the depressions engage the intermediate portion of one of the tails in the column.

* * * * *